US008534662B2

(12) United States Patent
Matsunaga

(10) Patent No.: US 8,534,662 B2
(45) Date of Patent: Sep. 17, 2013

(54) IMAGE FORMING APPARATUS, CONTROL METHOD THEREFOR, AND COMPUTER-READABLE MEDIUM

(71) Applicant: Canon Kabushiki Kaisha, Tokyo (JP)

(72) Inventor: Akira Matsunaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/706,139

(22) Filed: Dec. 5, 2012

(65) Prior Publication Data

US 2013/0181390 A1 Jul. 18, 2013

(30) Foreign Application Priority Data

Jan. 13, 2012 (JP) ..... 2012-005666

(51) Int. Cl.
*B65H 3/44* (2006.01)

(52) U.S. Cl.
USPC ..... 271/9.01

(58) Field of Classification Search
USPC ..... 271/9.01; 700/101, 128, 213; 399/16, 399/18, 12, 11, 10
See application file for complete search history.

(56) References Cited

U.S. PATENT DOCUMENTS 6,055,047 A * 4/2000 Schweizer et al. ..... 356/237.1
8,226,185 B2 * 7/2012 Jones et al. ..... 347/5

FOREIGN PATENT DOCUMENTS

JP 2011-32081 A 2/2011

* cited by examiner

*Primary Examiner* — David H Bollinger
(74) *Attorney, Agent, or Firm* — Fitzpatrick, Cella, Harper & Scinto

(57) ABSTRACT

An image forming apparatus which includes a plurality of feeding units each formed by an exchangeable part, and selects one of the plurality of feeding units based on priority levels of the plurality of feeding units in a feed operation, comprises: a monitoring unit which monitors a consumed level of the part forming the feeding unit; a notification unit which sends a notification to a user in a case where the monitoring unit detects that a life-time of the part has been reached; an ordering unit which orders the part before the monitoring unit detects that the life-time of the part has been reached; and a changing unit which changes the priority level of the feeding unit formed by the part being ordered to be lower than the priority levels of other feeding units.

8 Claims, 8 Drawing Sheets

500

| 501 PART ID | 502 CURRENT COUNTER VALUE | 503 ORDER TIMING VALUE | 504 LIFE-TIME WARNING VALUE | 505 PREDETERMINED LIFE-TIME | 506 ORDER FLAG |
|---|---|---|---|---|---|
| 100001 | 248610 | 240000 | 245000 | 250000 | ON |
| 100002 | 105627 | 240000 | 245000 | 250000 | OFF |
| 100003 | 20041 | 240000 | 245000 | 250000 | OFF |
| 100004 | 200455 | 240000 | 245000 | 250000 | OFF |
| . . . | . . . | . . . | . . . | . . . | . . . |

IMAGE FORMING APPARATUS, CONTROL METHOD THEREFOR, AND COMPUTER-READABLE MEDIUM

BACKGROUND OF THE INVENTION

1. Field of the Invention

The present invention relates to an image forming apparatus, a control method therefor, and a computer-readable medium and, more particularly, to an image forming apparatus including a function of automatically ordering an exchange part.

2. Description of the Related Art

Various consumables and exchange parts used in an image forming apparatus such as a printer or copying machine are conventionally exchanged as part of maintenance when a serviceman or the like visits the user regularly or upon receiving a report from him/her. Note that the various consumables indicate a toner bottle, a toner cartridge, and the like, and the exchange parts indicate a dram unit, a feed roller, and the like.

To further reduce the down time of the image forming apparatus in the future, however, it is desirable that the user can readily perform maintenance operations without depending on operations by the serviceman.

To meet the needs, an image forming system has been considered in which an image forming apparatus determines, if the remaining amount of a consumable is small or an exchange part consumed level is high, that it will be necessary to exchange the consumable or part soon, and automatically orders it. The system is characterized in that an order is sent before a conventional life-time warning in consideration of the number of dates necessary for delivery and the like.

On the other hand, in the image forming apparatus, a rubber part of the feed roller, which contacts a paper sheet, wears due to the use of it over a long period, and thus a feed failure occurs, thereby causing a paper jam. To solve this problem, for example, a technique described in Japanese Patent Laid-Open No. 2011-32081 been proposed. In this conventional technique, a feed speed when a paper sheet is sent out from a feed cassette is detected. If the detected speed becomes lower than a preset value, the priority level of the feed cassette for being selected as a feed source is changed.

In the above-described automatic order system, ordering the feed roller indicates that deterioration of the feed roller has occurred at this time. If a paper sheet is repeatedly fed in this state, a device malfunction such as a paper jam due to a feed failure may often occur.

To avoid this problem, the technique described in Japanese Patent Laid-Open No. 2011-32081 is applicable. In this technique, however, the consumed level of the feed roller is determined by successively detecting a feed speed, a protection operation of changing the priority level works in a next feed operation.

The present invention has been made in consideration of the above technical background, and provides an image forming apparatus for automatically ordering a feed roller to avoid, at an early timing as compared with the conventional technique, a situation in which a deteriorating feed roller is frequently used to cause a device malfunction such as a paper jam to often occur.

SUMMARY OF THE INVENTION

According to one aspect of the present invention, there is provided an image forming apparatus which includes a plurality of feeding units each formed by an exchangeable part, and selects one of the plurality of feeding units based on priority levels of the plurality of feeding units in a feed operation, comprising: a monitoring unit configured to monitor a consumed level of the part forming the feeding unit; a notification unit configured to send a notification to a user in a case where the monitoring unit detects that a life-time of the part has been reached; an ordering unit configured to order the part before the monitoring unit detects that the life-time of the part has been reached; and a changing unit configured to change the priority level of the feeding unit formed by the part being ordered to be lower than the priority levels of other feeding units.

According to another aspect of the present invention, there is provided a control method for an image forming apparatus which includes a plurality of feeding units each formed by an exchangeable part, and selects one of the plurality of feeding units based on priority levels of the plurality of feeding units in a feed operation, the method comprising: monitoring a consumed level of the part forming the feeding unit; sending a notification to a user in a case where it is detected in the monitoring step that a life-time of the part has been reached; ordering the part before it is detected in the monitoring step that the life-time of the part has been reached; and changing the priority level of the feeding unit formed by the part being ordered to be lower than the priority levels of other feeding units.

According to the present invention, it is possible to reduce the frequency of occurrence of a malfunction in an image forming apparatus as compared with the conventional technique, thereby enabling to continue a stable feed operation.

Further features of the present invention will become apparent from the following description of exemplary embodiments (with reference to the attached drawings).

DESCRIPTION OF THE EMBODIMENTS

Embodiments for carrying out the present invention will be described below with reference to the accompanying drawings.

First Embodiment

System Configuration

Figure 1:
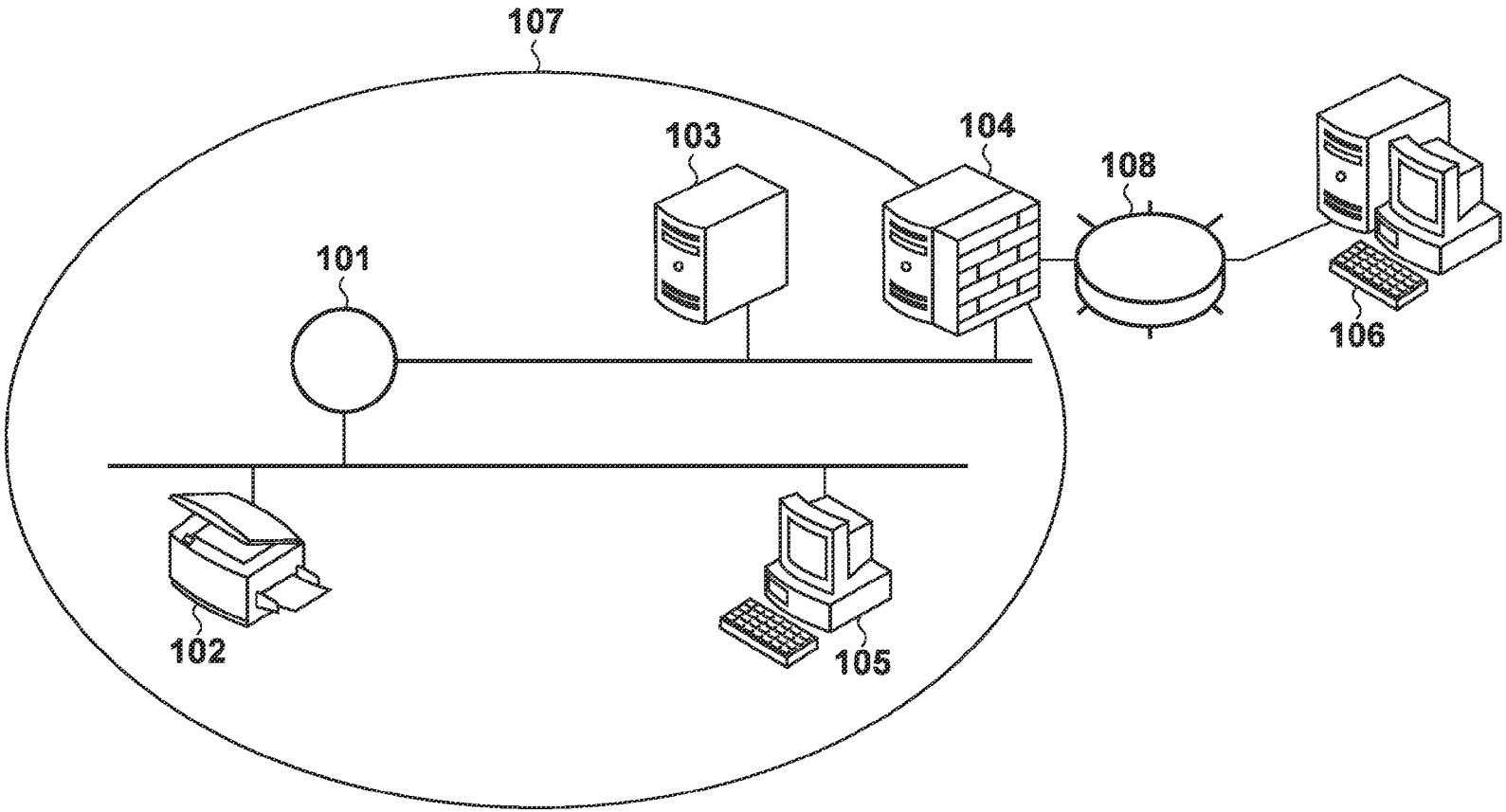
FIG. 1 is a view showing an example of the overall configuration of an image forming system.

FIG. 1 is a view for explaining the configuration of an image forming system according to the embodiment. FIG. 1 shows an example of the image forming system in which an image forming apparatus 102 and a management server 106 are connected to each other via the Internet. Note that the image forming apparatus 102 includes a printer or an MFP (MultiFunction Peripheral).

Referring to FIG. 1, a LAN (Local Area Network) 101 communicably connects the image forming apparatus 102 to be managed by the management server 106 with information processing apparatuses 104 and 105. An information processing apparatus 103 serves as a proxy server. Furthermore, the information processing apparatus 104 serves as a firewall arranged for increasing the security of communication with the Internet 108.

The personal computers (PCs) 105 are used by general users for business operations, and are interconnected via the LAN 101. The management server 106 collectively manages the operation states of a plurality of image forming apparatuses 102 arranged within the firewall (in an intranet environment 107). Note that the management server 106 receives the operation mode setting of the image forming apparatus 102, operation information such as a counter value and operation log, failure information indicating a hardware failure or frequent paper jams, a notification about a part automatic order, and the like. Note that in the actual image forming system, a plurality of intranet environments 107 and the management server 106 are interconnected via the Internet 108.

The image forming apparatus 102 performs communication via the LAN 101 according to its own communication schedule. At this time, the image forming apparatus 102 processes its own operation mode setting, operation information such as a counter value and operation log, failure information indicating a hardware failure or frequent paper jams, a notification about a part automatic order, and the like to obtain communication data, and then transmits them to the management server 106 via the Internet 108.

Furthermore, the management server 106 sends, to the image forming apparatus 102, a command instruction to update setting information or to restart the apparatus. As a communication method for this operation, MIB (Management Information Base) is exchanged according to SNMP (Simple Network Management Protocol).

Although protocols such as HTTP and HTTPS are assumed to be the communication protocol, the present invention is not particularly limited to them. For example, in the example of the image forming system shown in FIG. 1, the image forming apparatus 102 uses HTTPS to transmit data to the management server 106 via the proxy server (information processing apparatus 103) and the firewall (information processing apparatus 104).

The management server 106 issues a command for the image forming apparatus 102 to control it. The image forming apparatus 102 acquires a command from the management server 106 at regular intervals (or in response to an instruction from the management server 106) (to be referred to as a command request hereinafter). The command issued by the management server 106 is, therefore, saved within the management server 106 until it is acquired by the image forming apparatus 102.

As a command acquisition method, for example, the image forming apparatus 102 uses an SSL certificate saved within itself to perform HTTPS communication with the management server 106. At this time, when the image forming apparatus 102 starts communication using a specific SSL certificate, the management server 106 recognizes that the communication partner is an image forming apparatus as a management target.

A monitoring apparatus (not shown) for executing the following communication processing is arranged within, for example, the image forming apparatus 102. The monitoring apparatus is assigned with an ID for uniquely identifying the apparatus. After HTTPS communication is established, the monitoring apparatus uses a protocol such as SOAP to transmit the ID to the management server 106. This allows the management server 106 to specify the image forming apparatus 102 which has performed communication.

The management server 106 enables to control the specific image forming apparatus 102 via the Internet 108 by adding a command to a response to the ID.

[Image Forming Apparatus]

Figure 2:
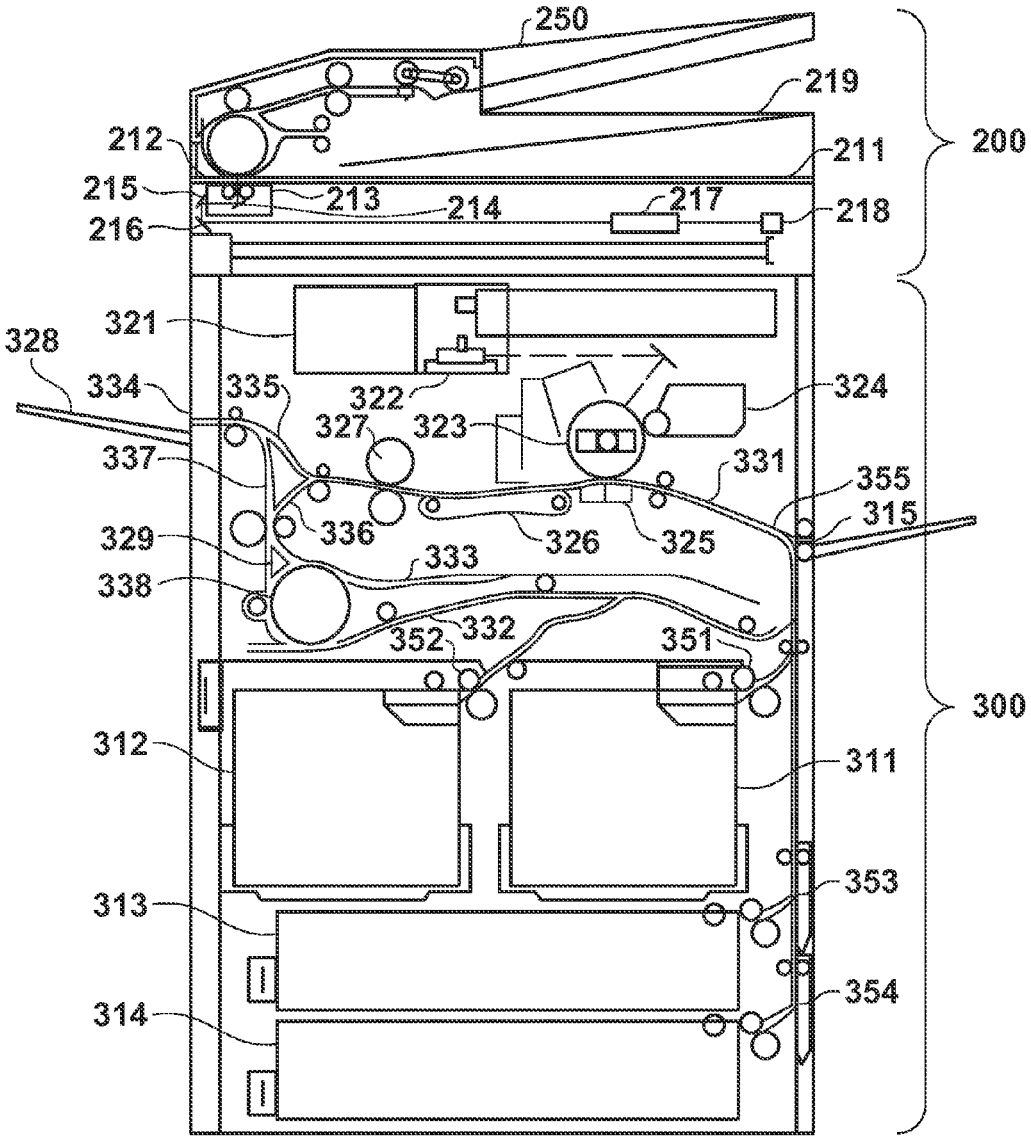
FIG. 2 is a sectional view showing an example of the reader unit and printer unit of an image forming apparatus 102.

FIG. 2 is a sectional view showing the hardware arrangement of the image forming apparatus 102 shown in FIG. 1.

The document feeding unit of a reader unit 200 feeds documents one by one from the top onto a platen glass 211. After the end of a document reading operation, the document feeding unit discharges the document on the platen glass 211 to a discharge tray 219. When a document is conveyed onto the platen glass 211, a lamp 212 is turned on, and an optical unit 213 starts moving to expose and scan the document. Light reflected by the document at this time is guided to a CCD image sensor (to be referred to as a CCD hereinafter) 218 by mirrors 214 to 216 and a lens 217. The CCD 218 reads the scanned document image. Image data output from the CCD 218 undergoes predetermined processing and is then transferred to the controller unit 400. The reader unit 200 includes a document detection sensor 250 which detects the presence/absence of a document. The document detection sensor 250 is formed by a lever sensor or optical sensor.

A laser driver 321 of a printer unit 300 drives a laser emitting unit 322 to emit a laser beam corresponding to the image data output from the controller unit 400. The laser beam irradiates a photosensitive drum 323, on which a latent image corresponding to the laser beam is formed. A developing unit 324 applies a developer to the latent image portion on the photosensitive drum 323.

The printer unit 300 includes, as paper storage units (feeding units), drawer-shaped cassettes 311 to 314 and a manual feed stage 315 on a tray exposed outside of the apparatus. They will be collectively called "feed stages" hereinafter. Except for the manual feed stage 315, paper sheets are conventionally supplied by drawing a cassette, adding paper sheets as printing media in it, and closing it.

Each feed stage includes a feed sensor. Sensors 351, 352, 353, and 354 are provided in the cassettes 311, 312, 313, and 314, respectively. A sensor 355 is provided in the manual feed stage 315.

In synchronism with the start of emission of a laser beam, a paper sheet is fed from one of the cassettes 311 to 314 and the manual feed stage 315, and is conveyed to a transfer unit 325 through a conveyance path 331 to transfer, to the paper sheet, the developer attached to the photosensitive drum 323. A conveyance belt 326 conveys the developer-attached paper sheet to a fixing unit 327, and the developer is fixed onto the paper sheet by the heat and pressure of the fixing unit 327. The paper sheet having passed through the fixing unit 327 is discharged through conveyance paths 335 and 334. Alternatively, to reverse the printed surface and then discharge the paper sheet, the paper sheet is guided to a conveyance path 338 through a conveyance path 336, and conveyed from there in an opposite direction to pass through conveyance paths 337 and 334.

When double-sided printing is set, the paper sheet is guided from the conveyance path 336 to a conveyance path 333 by a flapper 329 after passing through the fixing unit 327. The paper sheet is then conveyed in an opposite direction, and guided to a re-feed conveyance path 332 through the conveyance path 338 by the flapper 329. The paper sheet guided to the re-feed conveyance path 332 is fed again to the transfer unit 325 through the conveyance path 331 at the above-described timing. The paper sheet discharged through the conveyance path 334 is conveyed to a discharge bin 328 and stacked.

[Cassette]

Figure 10:
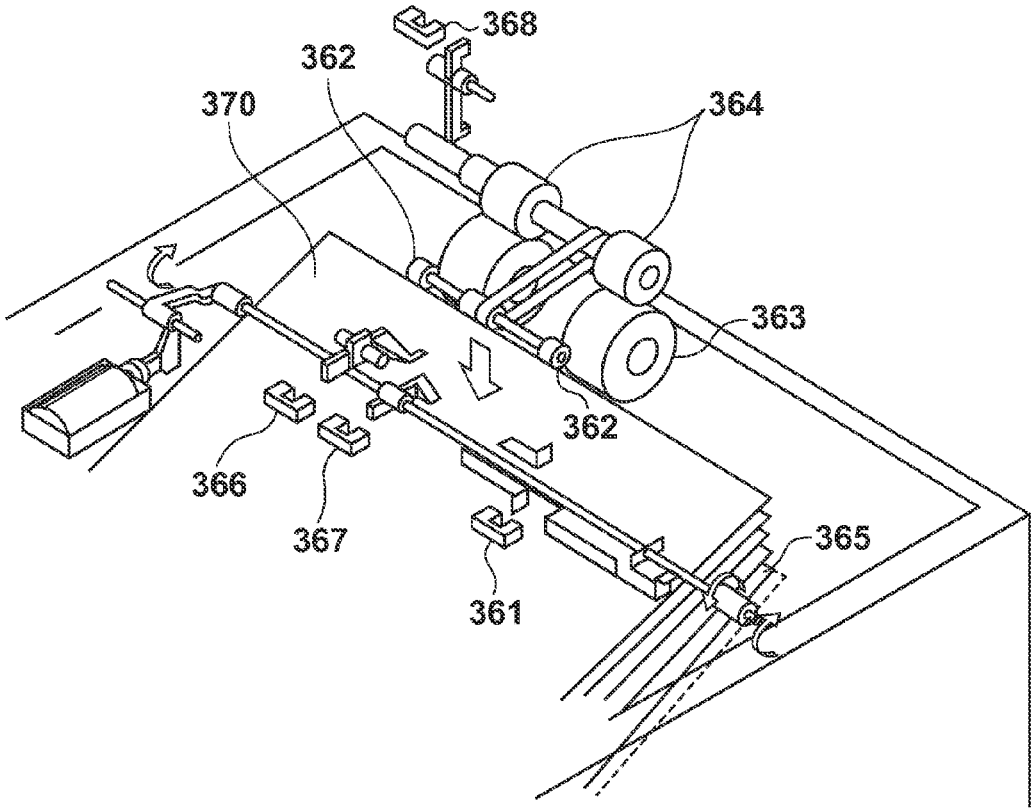
FIG. 10 is a view showing an example of the detailed arrangement of a cassette 311.

FIG. 10 shows the arrangement of the cassette 311 of the feed stages of the printer unit 300. The cassette 311 includes a cassette opening/closing sensor 361, a feed roller 362, a separation roller 363, a conveyance roller 364, a lifter 365, a lift position detection sensor 366, a paper detection sensor 367, and a feed sensor 368. The cassette opening/closing sensor 361 detects opening/closing of the cassette. The feed roller 362 feeds a supplied paper sheet. The separation roller 363 separates the stacked paper sheets not to feed a plurality of paper sheets. The conveyance roller 364 conveys a separate paper sheet to a conveyance path. The lifter 365 lifts up the supplied paper sheet to contact the feed roller. The lift position detection sensor 366 detects the lift-up position of the paper sheet by the lifter 365. The paper detection sensor 367 detects whether there is a paper sheet within the cassette. The feed sensor 368 detects whether a paper sheet has been successfully fed. Paper sheets 370 shown in FIG. 10 indicate paper sheets supplied in the cassette 311.

[Controller Unit]

Figure 3:
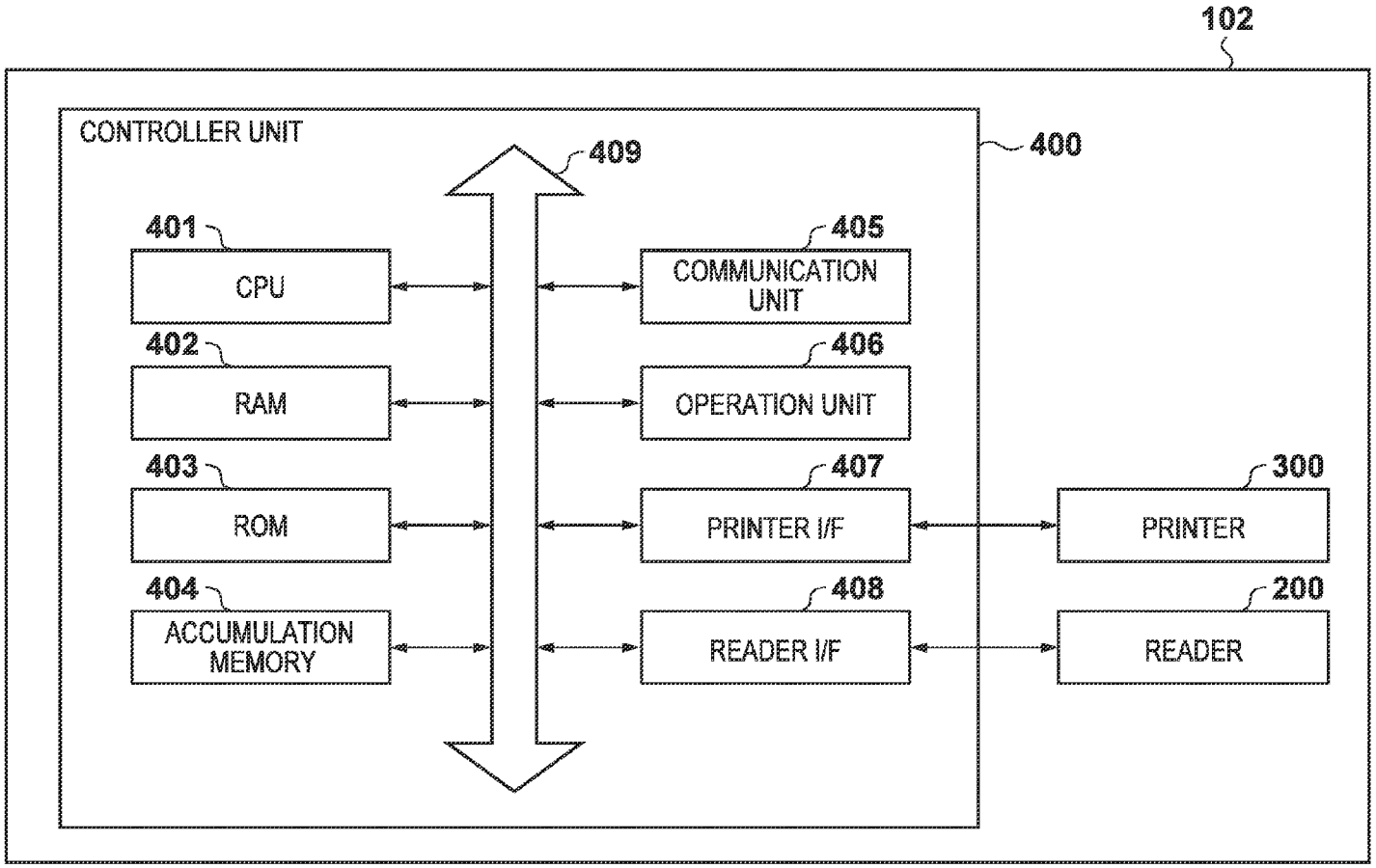
FIG. 3 is a block diagram showing an example of the arrangement of the image forming apparatus 102.

The arrangement of the controller unit 400 within the image forming apparatus 102 will be described based on a block diagram shown in FIG. 3. Each component of the controller unit 400 is connected with a system bus 409.

A ROM 403 stores a control program for the image forming apparatus 102. A CPU 401 executes the control program. The control program includes a program in which instructions associated with processing in FIG. 4 (to be described later) are described. A RAM 402 is used as, for example, a work memory area for executing a program, and an image memory area for temporarily storing image data.

An accumulation memory 404 is a nonvolatile memory, and stores various data which need to be stored even after the image forming apparatus 102 is turned off. The accumulation memory 404 stores, for example, information such as an operation log, error, jam error, and alarm log. An operation unit 406 includes a display unit in addition to various function keys and a ten-key pad. By operating these keys, the user can instruct to start/stop an operation or instruct various settings when using a function provided by the image forming apparatus 102, such as a copy or scan function.

Furthermore, the user can designate, through the operation unit 406, various settings for the image forming apparatus 102 itself, and the paper size and paper type of paper sheets accommodated in each of the cassettes 311 to 315. The operation signal of each key is input to the CPU 401, which then executes processing corresponding to the key. The CPU 401 displays various screens on the display unit (not shown) of the operation unit 406 as needed.

A communication unit 405 serves as an interface unit for connecting to the LAN 101 shown in FIG. 1. The CPU 401 can execute communication processing with the management server 106 via the communication unit 405. A reader I/F 408 serves as an interface unit for controlling driving of the reader unit 200. A printer I/F 407 serves as an interface unit for controlling driving of the printer unit 300.

[Automatic Order Processing]

Feed roller automatic order processing in the image forming system shown in FIG. 1 will be described with reference to FIGS. 4, 5, and 6.

Figures 4, 5:
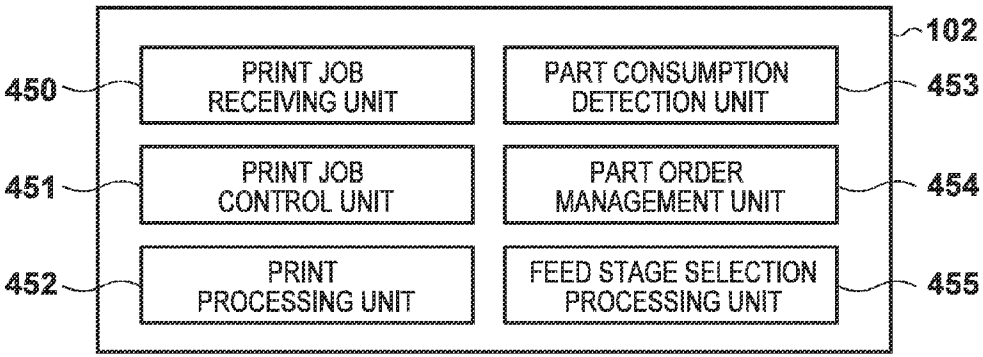
FIG. 4 is a block diagram showing an example of the configuration of a control program executed by the image forming apparatus 102.
FIG. 5 is a table showing an example of the registered data of a part management table.

FIG. 4 shows an example of the configuration of the control program executed by the CPU 401 of the image forming apparatus 102. A print job receiving unit 450 receives a print job, and calls a print job control unit 451. The print job control unit 451 controls the received print job, and calls a print processing unit 452. The print processing unit 452 processes print data. A feed stage selection processing unit 455 is called when it is necessary to feed a printing paper sheet to execute the print processing unit 452 by the print job control unit 451, and determines, according to the setting of the print job, a feed stage as a feed source to feed a paper sheet.

A part consumption detection unit 453 detects the consumed level of each exchangeable part to be automatically ordered. At this time, the part consumption detection unit 453 detects in consideration of the consumption characteristics which vary depending on the type of part. In this embodiment, a part to be automatically ordered is the feed roller of each feed stage, and the characteristics indicate the number of times the feed roller is used to feed a printing paper sheet. A part order management unit 454 manages, as data (to be described later), the consumed level of each part detected by the part consumption detection unit 453. If the consumed level satisfies a predetermined condition, a delivery request notification is sent to the management server 106.

Note that information about the consumed level of each part and the like are managed as a part management table 500 shown in FIG. 5, and are stored in the accumulation memory 404. In the part management table 500, a part ID 501, a current counter value 502, an order timing value 503, a life-time warning value 504, a predetermined life-time value 505, and an order flag 506 are defined in advance and registered. Note that the structure of the part management table 500 shown in FIG. 5 is merely an example, and different values may be defined and registered according to the characteristics of each part.

The part ID 501 is a number for uniquely specifying each feed roller. For example, "100001" indicates a feed roller used in the cassette 311 of FIG. 1. Similarly, a part ID is assigned to each of the feed rollers mounted in the cassettes of the image forming apparatus 102. The current counter value 502 indicates the number of times a feed roller indicated by the part ID 501 is used to feed a printing paper sheet. Note that if a feed roller is exchanged due to consumption or the like, the current counter value 502 is reset. The order timing value 503 is a threshold for automatically ordering the feed roller.

The life-time warning value 504 indicates the number of feed operations to warn that the life-time of the feed roller indicated by the part ID 501 is about to end. The predetermined life-time value 505 indicates the limit of the number of feed operations processible by the feed roller indicated by the part ID 501.

(Processing Procedure)

Figure 6:
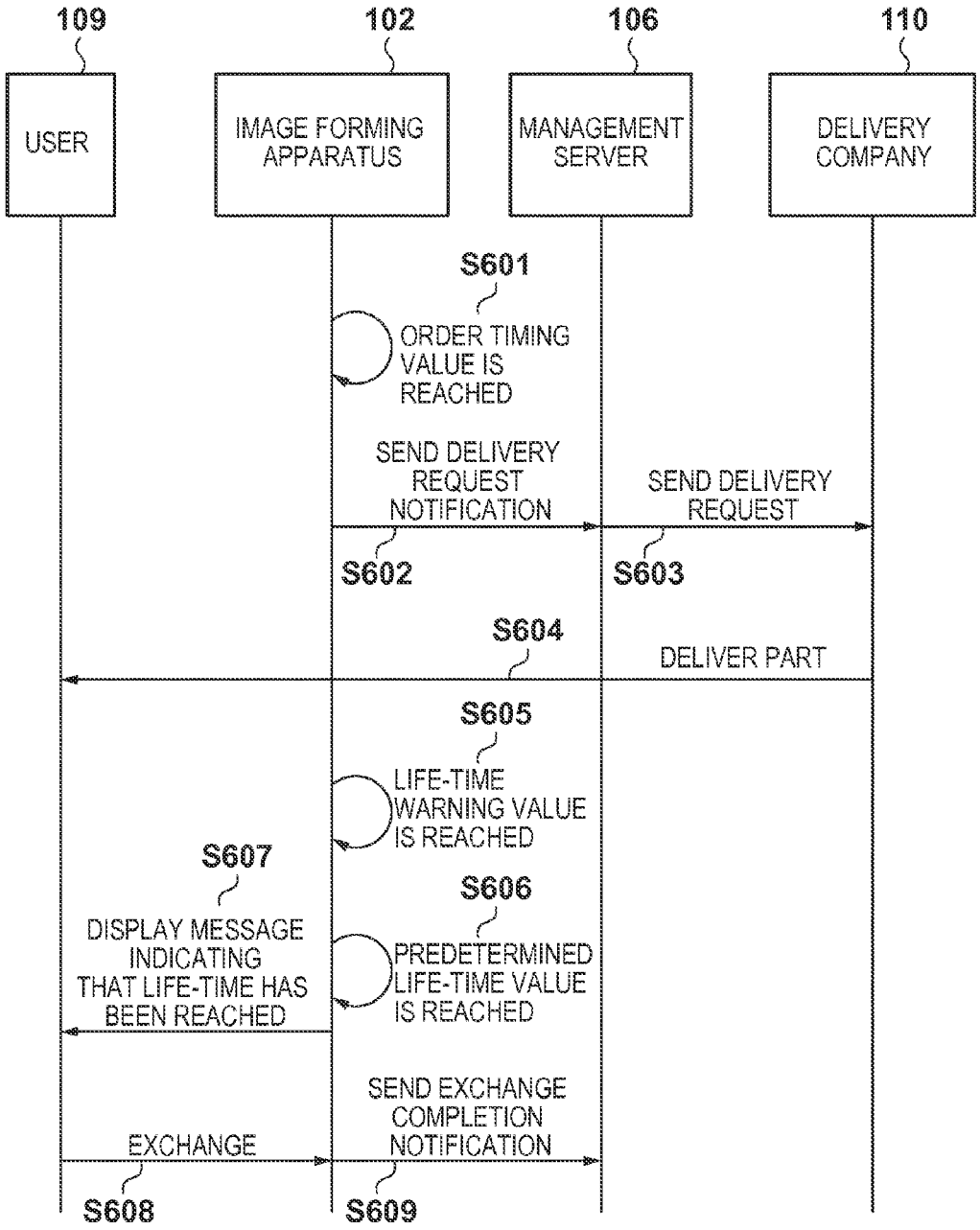
FIG. 6 is a sequence chart showing an example of a feed roller automatic order procedure.

FIG. 6 is a sequence chart showing the procedure of the feed roller automatic order processing. A case in which the feed roller with the part ID 501 of "100001" is ordered will be described.

The part order management unit 454 of the image forming apparatus 102 detects that the current counter value 502 of the part ID "100001" has reached the order timing value 503 (S601). This triggers the part order management unit 454 to send an exchange feed roller delivery request notification to the management server 106 (S602). At this time, the part order management unit 454 changes the order flag 506 of the part ID "100001" managed in the part management table 500 from "OFF" to "ON". Upon receiving the delivery request notification from the image forming apparatus 102, the management server 106 sends an appropriate delivery request to a delivery company 110 in response to the request (S603). The delivery request sent by the management server 106 may have any form such as email. The delivery company 110 delivers an exchange feed roller to a user 109 as a designated delivery destination according to the delivery request (S604).

If the feed roller with the part ID "100001" is continuously used, the current counter value 502 reaches the life-time warning value 504 (S605). In the embodiment, however, the part order management unit 454 does nothing at this timing. If the feed roller with the part ID "100001" is continuously used thereafter, the part order management unit 454 detects that the current counter value 502 has reached the predetermined life-time value 505 (S606). This triggers the part order management unit 454 to display, for the user 109, a warning message indicating that the feed roller needs to be exchanged (S607).

Upon receiving the warning message, the user 109 exchanges the feed roller with the part ID "100001" for a delivered exchange feed roller (S608). Upon completion of the exchange operation, the part order management unit 454 sends a feed roller exchange completion notification to the management server 106 (S609). At the same time, the part order management unit 454 changes the order flag 506 of the part ID "100001" from "ON" to "OFF".

Referring to the above description, the order flag 506 is "ON" from when the delivery request notification is sent (S602) until the exchange completion notification is sent (S609).

Note that the consumed level for determining the feed roller order timing is not limited to the current counter value 502 of the feed roller shown in the embodiment. For example, the operation time of the feed roller, the paper jam rate or paper slip rate when the feed roller is used, or a combination thereof may be used. In this case, the part management table 500 manages a corresponding value.

Although in this embodiment, a part to be exchanged is a feed roller, it may be another consumable having an influence on the print efficiency. Furthermore, the present invention may be applied to a plurality of parts mounted in one feed stage.

Although in this embodiment, a life-time warning is not displayed in S605, it may be displayed so that an administrator or the like can check it. Furthermore, if the delivery request notification is sent in S602, information indicating it may be displayed.

(Processing Procedure)

Figure 7:
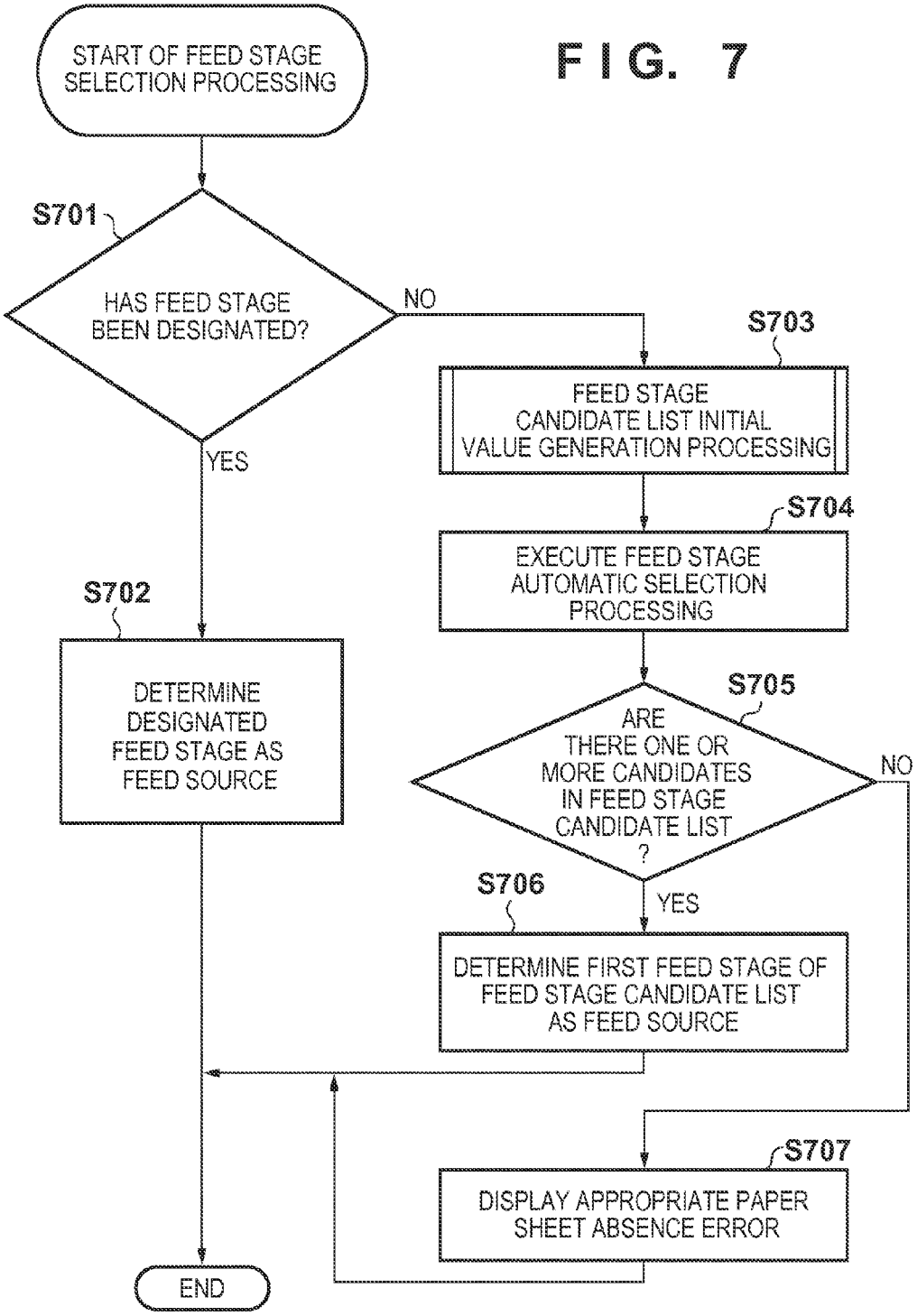
FIG. 7 is a flowchart illustrating an example of the operation of a feed stage selection processing unit 455.

The procedure of feed stage selection processing by the feed stage selection processing unit 455 of the image forming apparatus 102 will be described with reference to a flowchart shown in FIG. 7. Note that processing in each step of the flowchart in FIG. 7 is implemented when the CPU 401 shown in FIG. 3 loads the control program stored in the ROM 403 into the RAM 402, and executes it.

After the start of the processing, the feed stage selection processing unit 455 determines whether a feed stage has been designated in a print job (step S701). If a specific feed stage has been designated as a feed source (YES in step S701), the process advances to step S702, in which the feed stage selection processing unit 455 determines the designated feed stage as a feed source. The processing then ends. If no specific feed stage has been designated (NO in step S701), that is, "feed stage automatic selection setting" has been designated, the process advances to step S703. The feed stage automatic selection setting indicates a mode in which the image forming apparatus selects a feed stage to feed a paper sheet from the plurality of feed stages.

In step S703, the feed stage selection processing unit 455 executes feed stage candidate list initial value generation processing of making a list of feed stages as feed source candidates. Of the listed feed stages, the first feed stage of the feed stage candidate list has a highest priority level, and the last feed stage of the feed stage candidate list has a lowest priority level. Note that the processing in step S703 will be described in detail later with reference to FIG. 8.

In step S704, the feed stage selection processing unit 455 executes feed stage automatic selection processing. In this processing, the feed stage selection processing unit 455 determines an appropriate print paper size based on the size of an input document and a combination of various settings in an image forming mode such as a printing scale, output format, and image quality. The feed stage selection processing unit 455 makes a paper feed candidate list of feed stages in which printing paper sheets with the determined size have been supplied. In other words, feed stages which do not satisfy the condition are excluded from the feed stage candidate list (initial value) created in step S703.

In step S705, the feed stage selection processing unit 455 determines whether one or more feed stages are in the feed stage candidate list as the result of the feed stage automatic selection processing (step S704). If one or more feed stages are in the list (YES in step S705), the process advances to step S706, in which the feed stage selection processing unit 455 determines the first feed stage of the feed stage candidate list as a feed source. The processing procedure then ends.

On the other hand, if no feed stage is in the list (NO in step S705), the process advances to step S707, in which the feed stage selection processing unit 455 displays an warning message indicating an appropriate paper sheet absence error on the display unit (not shown) of the operation unit 406 of the image forming apparatus 102. This prompts the user to exchange the printing paper sheets in one of the feed stages for paper sheets appropriate for execution of the print job. The processing procedure then ends.

(Initial Value Generation Processing)

Figure 8:
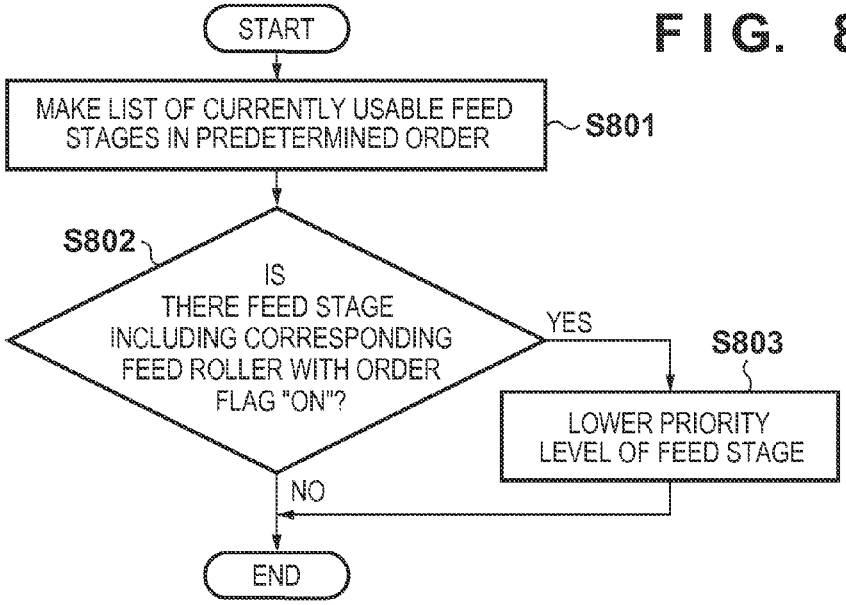
FIG. 8 is a flowchart illustrating feed stage candidate list initial value generation processing according to the first embodiment.

The above-described feed stage candidate list initial value generation processing (step S703 of FIG. 7) will be described in detail with reference to a flowchart shown in FIG. 8. Note that the feed stage selection processing unit 455 executes the processing procedure, similarly to the processing of FIG. 7.

In step S801, the feed stage selection processing unit 455 makes a list of currently usable feed stages of the image forming apparatus 102. The priority order of the feed stages at this time is a device-specific order determined in advance based on various conditions such as the performance. Note that the priority order definition conditions used here are not particularly limited.

In step S802, the feed stage selection processing unit 455 determines, for each of the feed stages of the feed stage candidate list, whether delivery is being requested for the feed roller used to convey a paper sheet from the feed stage. This determination is made depending on whether the order flag 506 of the above-described part management table 500 is "ON". The feed roller used to convey a paper sheet will be referred to as a "corresponding feed roller" hereinafter. If there is a feed stage for which the order flag 506 of a corresponding feed roller is "ON" (YES in step S802), the process advances to step S803.

In step S803, the feed stage selection processing unit 455 changes the priority level, in the feed stage candidate list, of the feed stage including the corresponding feed roller for which delivery is being requested. More specifically, the feed stage selection processing unit 455 sequentially checks the feed stages of the feed stage candidate list from the top. If the feed stage selection processing unit 455 finds a feed stage including a corresponding feed roller for which delivery is being requested, the feed stage selection processing unit 455 lowers the priority level of the feed stage by moving it to the end of the feed stage candidate list. The processing procedure then ends to return to the processing shown in FIG. 7. This sets the priority levels of the feed stages to be selected in the feed stage candidate list.

As described above, it is possible to reduce the frequency with which a feed stage including a corresponding feed roller for which delivery is being requested is determined as a feed source when the feed stage automatic selection setting is designated. This results in the stable operation of the image forming apparatus as a whole with a lower probability of failure.

Second Embodiment

In the first embodiment, a frequency with which a feed stage including a corresponding feed roller for which delivery is being requested is selected is reduced by lowering the priority level of the feed stage in the feed source determination process of the feed stage automatic selection processing. A feed stage may be always selected as a feed source even using the above-described method, for example, when all the feed stages hold paper sheets with different sizes.

To solve this problem, the feed stage including the corresponding feed roller for which delivery is being requested may be prevented from being selected in the feed stage automatic selection processing when a predetermined period of time has elapsed after sending a feed roller delivery request notification. That is, even though the delivery request has been sent, the corresponding part has not been exchanged even after the predetermined period of time has elapsed. In this case, for example, "delivery request date/time" is newly added to a part management table 500 shown in FIG. 5, and the data/time when a part order management unit 454 sends an order request notification is registered.

Figure 9:
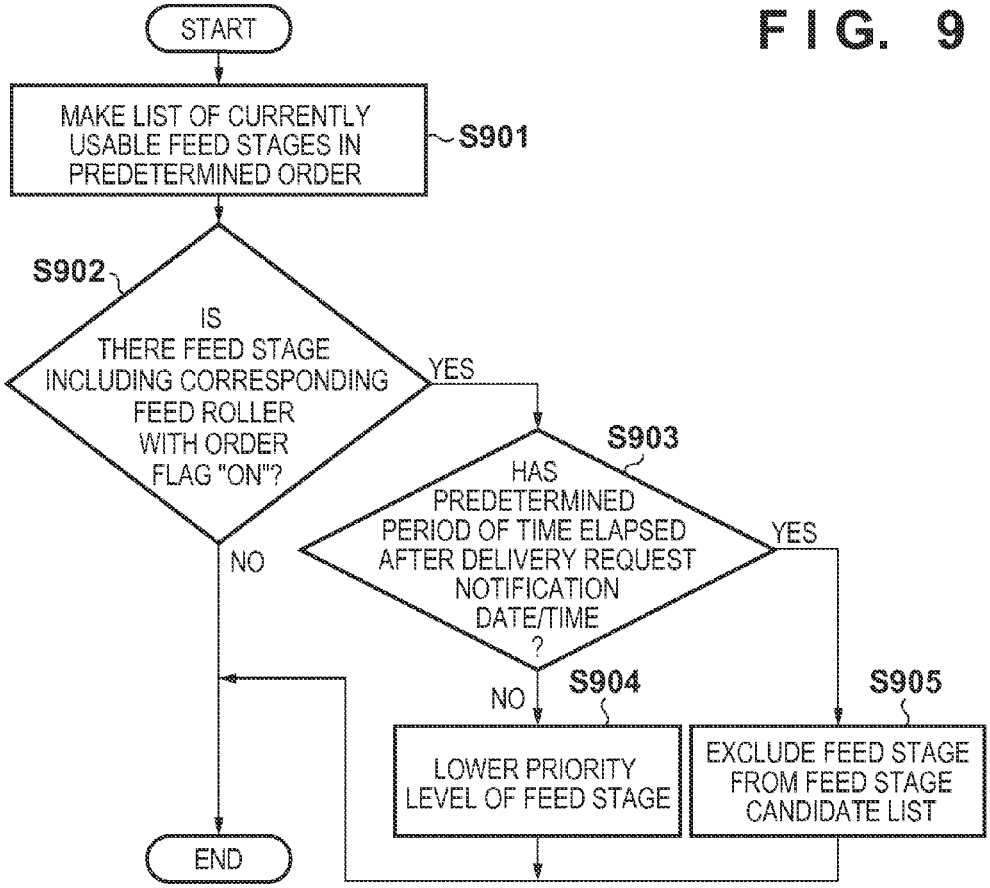
FIG. 9 is a flowchart illustrating feed stage candidate list initial value generation processing according to the second embodiment.

A system configuration and the like except for initial value generation processing in step S703 of FIG. 7 in this embodiment are the same as those in the first embodiment, and a repetitive description thereof will be omitted. The initial value generation processing in step S703 of FIG. 7 according to the embodiment will be described in detail with reference to a flowchart shown in FIG. 9. Note that in this embodiment, the feed stage selection processing unit 455 executes the processing, similarly to the first embodiment.

In step S901, the feed stage selection processing unit 455 makes a list of currently usable feed stages of an image forming apparatus 102. The priority order of the feed stages at this time is a device-specific order determined in advance based on various conditions such as the performance. Note that the priority order definition conditions used here are not particularly limited.

In step S902, the feed stage selection processing unit 455 determines, for each of the feed stages of the feed stage candidate list, whether the order flag of a corresponding feed roller is "ON". If there is a feed stage for which the order flag of a corresponding feed roller is "ON" (YES in step S902), the process advances to step S903; otherwise (NO in step S902), the processing procedure ends.

In step S903, the feed stage selection processing unit 455 determines whether a predetermined period of time has elapsed after the delivery request notification date/time of the feed roller with the order flag "ON". If the predetermined period of time has elapsed (YES in step S903), the process advances to step S905; otherwise (NO in step S903), the process advances to step S904.

In step S904, the feed stage selection processing unit 455 changes the priority level of the target feed stage of the feed source candidate list. More specifically, the feed stage selection processing unit 455 sequentially checks the feed stages of the feed stage candidate list from the top. If the feed stage selection processing unit 455 finds a feed stage including a corresponding feed roller for which delivery is being requested, the feed stage selection processing unit 455 lowers the priority level of the feed stage by moving it to the end of the feed stage candidate list.

In step S905, the feed stage selection processing unit 455 excludes the target feed stage from the feed stage candidate list. More specifically, the feed stage selection processing unit 455 sequentially checks the feed stages of the feed stage candidate list from the top. If the feed stage selection processing unit 455 finds a feed stage for which the order flag of a corresponding feed roller is "ON" and the predetermined period of time has elapsed after the delivery request notification date/time of the feed roller, it excludes the feed stage from the feed stage candidate list.

After the processing in step S904 or S905 ends, the processing procedure ends.

This enables to reduce, as compared with the first embodiment, a frequency with which a feed stage is determined as a feed source when a feed stage automatic selection setting is designated, while delivery of a corresponding feed roller is being requested. This results in the stable operation of the image forming apparatus as a whole with a lower probability of failure.

Third Embodiment

In the first and second embodiments, a frequency with which a feed stage including a corresponding feed roller for which delivery is being requested is selected is reduced in the feed source determination process of the feed stage selection processing. In this case, the consumed level is determined using the current counter value 502 of the part management table 500 shown in FIG. 5. The consumed level of a feed roller, however, does not always increase at a uniform speed, and is known to increase with a smaller number of feed operations than usual depending on the type of printing paper sheets to be fed.

In addition to the arrangement described in the above embodiments, the apparatus may be configured not to designate a specific paper type for a given feed stage including a corresponding feed roller for which delivery is being requested. That is, a feed stage including a feed roller for which delivery is being requested (a feed roller with a high consumed level) is prevented from feeding a paper sheet which increases the consumed level as compared with a general paper type.

A system configuration and the like except for processing in step S602 of FIG. 6 in this embodiment are the same as those in the first embodiment, and a repetitive description thereof will be omitted. The processing in step S602 of FIG. 6 according to the embodiment will be described in detail. Note that a description will be provided using a feed roller with a part ID "100001".

When a current counter value reaches an order timing value (S601), a part order management unit 454 sends an exchange feed roller delivery request notification to a management server 106 (S602). The part order management unit 454 changes an order flag 506 of the part ID "100001" from "OFF" to "ON". The part order management unit 454 also limits a paper type to be designated for a feed stage including the feed roller with the part ID "100001" on condition that the order flag 506 is "ON".

More specifically, if the paper type currently set for a feed stage including a feed roller with a high consumed level should be limited, a warning message is displayed on a display unit (not shown) of an operation unit 406 of an image forming apparatus 102. The image forming apparatus 102 then prompts the user to change the paper type. If a paper type which increases the consumed level is not designated, the user is prevented from operating the operation unit 406 to change the paper type of the corresponding feed stage to a paper type which increases the consumed level. The paper type to be limited, which increases the consumed level, may be paper with a given grammage or more such as thick paper. Assume that an accumulation memory 404 stores, in advance, as device-specific information, information about a paper type to be limited, which increases the consumed level in one conveyance operation as compared with plain paper.

The apparatus is controlled to release the limitation when the part with the high consumed level is exchanged.

With the above processing, a feed stage does not feed a paper type which may rapidly increase the consumed level of a feed roller while delivery is being requested for a corresponding feed roller. This results in the stable operation of the image forming apparatus as a whole with a lower probability of failure.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-005666, filed Jan. 13, 2012, which is hereby incorporated by reference herein in its entirety.

What is claimed is:

1. An image forming apparatus which includes a plurality of feeding units each formed by an exchangeable part, and selects one of the plurality of feeding units based on priority levels of the plurality of feeding units in a feed operation, comprising:

a monitoring unit configured to monitor a consumed level of the part forming the feeding unit;

a notification unit configured to send a notification to a user in a case where said monitoring unit detects that a life-time of the part has been reached;

an ordering unit configured to order the part before said monitoring unit detects that the life-time of the part has been reached; and a changing unit configured to change the priority level of the feeding unit formed by the part being ordered to be lower than the priority levels of other feeding units.

2. The apparatus according to claim 1, wherein after said ordering unit orders the part, said changing unit sets the priority level of the feeding unit formed by the part being ordered to be lower until the part is exchanged.

3. The apparatus according to claim 1, wherein a type of printing medium to be fed by the feeding unit for which the priority level has been set to be lower by said changing unit is limited.

4. The apparatus according to claim 1, wherein in a case where a predetermined period of time has elapsed since said ordering unit orders the part, said changing unit excludes the feeding unit formed by the part from selection feeding unit candidates in a feed operation.

5. The apparatus according to claim 1, wherein in a case where said ordering unit orders the part or the life-time of the part is about to end, said notification unit further sends a notification.

6. The apparatus according to claim 1, wherein a consumed level at which said ordering unit orders the part, a consumed level at which said monitoring unit detects that the life-time of the part has been reached, or a consumed level at which said monitoring detects that the life-time of the part is about to end is defined in advance.

7. A non-transitory computer-readable medium storing a program for causing a computer to function as each unit according to claim 1.

8. A control method for an image forming apparatus which includes a plurality of feeding units each formed by an exchangeable part, and selects one of the plurality of feeding units based on priority levels of the plurality of feeding units in a feed operation, the method comprising:

monitoring a consumed level of the part forming the feeding unit;

sending a notification to a user in a case where it is detected in the monitoring step that a life-time of the part has been reached;

ordering the part before it is detected in the monitoring step that the life-time of the part has been reached; and changing the priority level of the feeding unit formed by the part being ordered to be lower than the priority levels of other feeding units.

* * * * *